United States Patent [19]

Brock et al.

[11] 3,965,844

[45] June 29, 1976

[54] APPARATUS FOR PIVOTALLY MOUNTING A FISHING MOTOR

[75] Inventors: John O. Brock; Marmion Dean Davis; James Robert Wray, all of Shelby, N.C.

[73] Assignee: Interstate Industries, Inc., Shelby, N.C.

[22] Filed: Mar. 27, 1975

[21] Appl. No.: 562,598

[52] U.S. Cl. ..... 115/41 R; 115/18 E; 248/4

[51] Int. Cl.[2] ..... B63H 21/26

[58] Field of Search ..... 115/41 R, 17, 18 R, 115/18 E, 18 A; 248/4

[56] References Cited

UNITED STATES PATENTS

| | | | |
|---|---|---|---|
| 3,062,175 | 11/1962 | Mitchell | 115/41 R |
| 3,604,674 | 9/1971 | Wilkerson | 115/17 |
| 3,724,790 | 4/1973 | Harris et al. | 115/17 |
| 3,870,258 | 3/1975 | Shimanckas et al. | 115/17 |

*Primary Examiner*—Trygve M. Blix
*Assistant Examiner*—Gregory W. O'Connor
*Attorney, Agent, or Firm*—Bell, Seltzer, Park & Gibson

[57] ABSTRACT

An apparatus for pivotally mounting an outboard fishing motor, such as a shaft-mounted submersible electric motor, on the bow of a fishing boat or the like for pivotal movement between an operative position wherein the motor is held in the water and a non-operative raised position. The apparatus comprises a pivotally mounted bracket for supporting the shaft of the motor, and a power control system including a reversible electric motor and cable arrangement for automatically and positively pivoting the fishing motor in either direction between its operative and non-operative positions.

12 Claims, 6 Drawing Figures

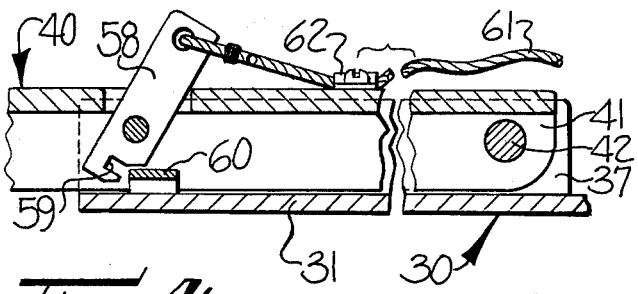
FIG-4
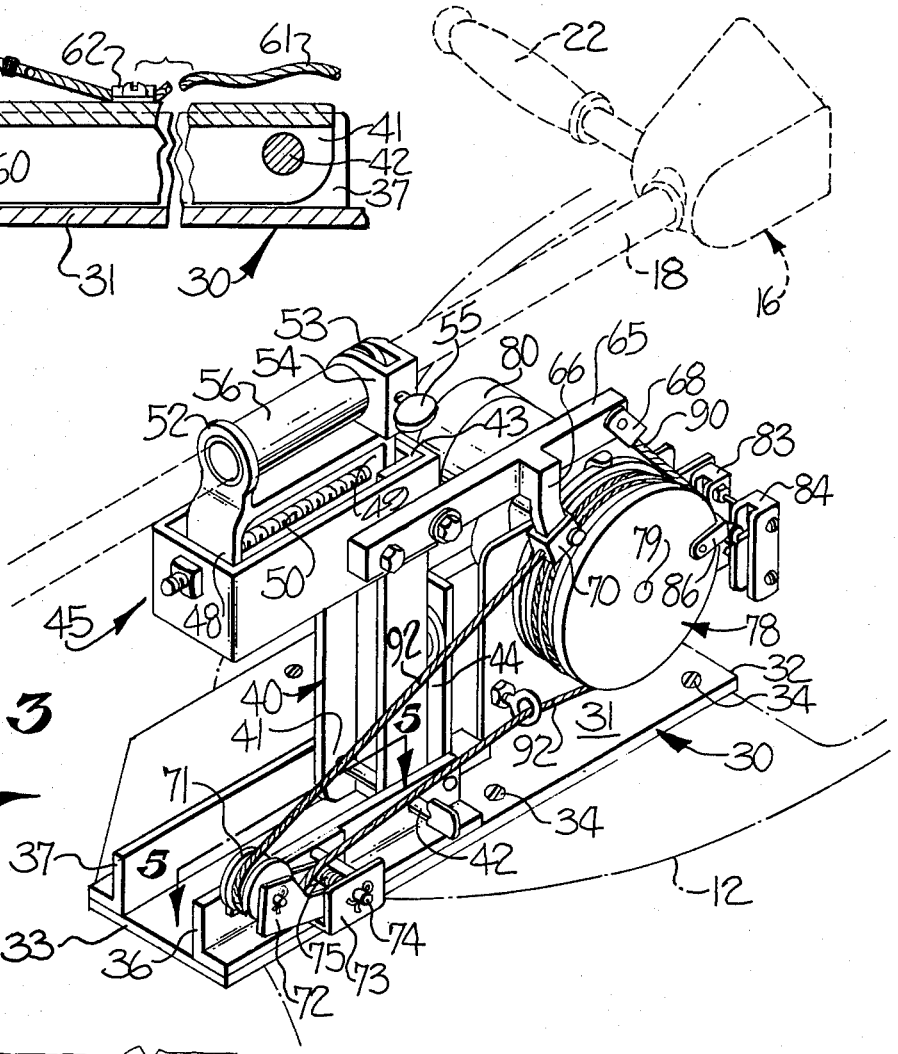
FIG-3
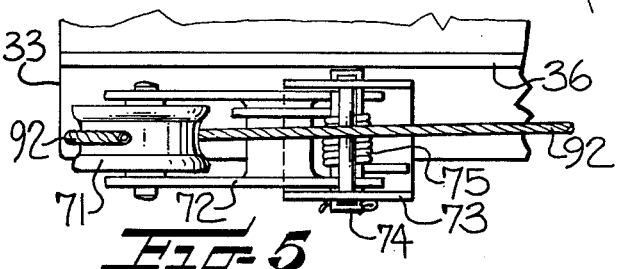
FIG-5
FIG-6
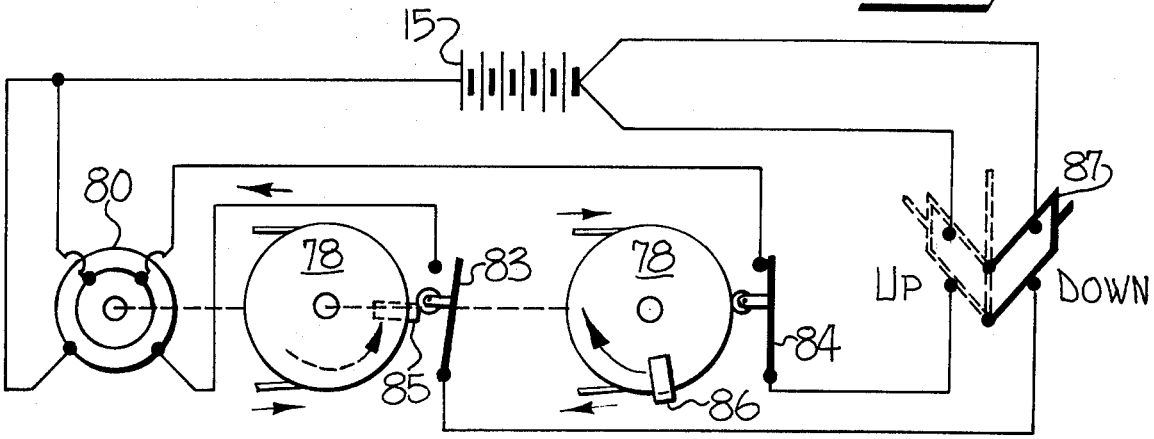

APPARATUS FOR PIVOTALLY MOUNTING A FISHING MOTOR

The present invention relates to a powered apparatus for automatically pivoting an outboard fishing motor between a lowered operative position wherein the motor is held in the water, and a raised non-operative position wherein the motor is removed from the water.

It is known to mount a small auxiliary motor on the bow of a fishing boat for use while trolling. Typically, the motor is a shaft-mounted electric motor, and comprises an elongated shaft having a submersible electric motor and propeller mounted at the lower end thereof, and a steering handle or the like mounted at the upper end of the shaft. The motor is powered by a suitable battery carried in the boat, and a speed control rheostat may also be provided for controlling the speed of the motor and thus the speed of the boat through the water.

It has also been proposed to pivotally mount a motor of the described type on the bow to permit the motor to be retracted from the water in the event the fishing lines become snagged, or if it is desired to move the boat under full power from the main motor. In this regard, various pivotal mounting brackets have been developed and marketed, and wherein the boat operator manually raises and lowers the motor between its operative and non-operative positions, note for example the patent to Ibbs, No. 3,245,640.

The above manual raising and lowering operations can easily become tiring and aggravating, particularly when it is realized that the boat operator normally is positioned in the middle or at the stern of the boat while fishing, and he must therefore move to the front of the boat each time the motor is to be raised or lowered. In this regard, various rope arrangements have been proposed for permitting the operator to raise or lower the motor while he is located at the middle or stern of the boat, but such ropes tend to become snagged in the fishing lines and other boat equipment, and thus they have not been entirely satisfactory.

It is accordingly an object of the present invention to provide an apparatus for pivoting an outboard fishing motor between its operative and non-operative positions and which avoids the above noted problems associated with the presently known devices.

It is another object of the present invention to provide a powered apparatus for selectively pivoting an outboard fishing motor, such as a shaft-mounted submersible electric motor, between a lowered position wherein the motor is operatively held in the water and a raised position wherein the motor is removed from the water.

It is a further object of the present invention to provide an apparatus of the described type which may be remotely controlled by the boat operator, and which automatically terminates its operation upon the motor reaching either the operative or the non-operative position.

It is still another object of the present invention to provide an apparatus of the described type which pivots the motor under controlled conditions in both directions, and which is essentially locked in its operative position to thereby preclude the motor from lifting from the water during operation.

These and other objects and advantages of the present invention are achieved in the embodiment illustrated herein by the provision of an apparatus which comprises a mounting frame adapted to be fixedly attached to the bow of the boat, a bracket pivotally carried by the mounting frame and being pivotable between a forward position wherein the bracket horizontally overlies the outer end of the frame and a retracted vertical position, means carried at the remote free end of the bracket for attaching the shaft of an outboard motor thereto, and power means for selectively and positively pivoting the bracket in either direction between its forward and retracted positions. In the illustrated embodiment, this power means takes the form of a drive wheel rotatably carried by the frame, an electric motor for selectively rotating the drive wheel in either direction, and a cable wound about the drive wheel and operatively connected to the bracket such that operation of the motor in one direction serves to pivot the bracket toward its retracted position and operation of the motor in the opposite direction serves to pivot the bracket toward its forward position. A manually operable switch may be provided for selectively operating the motor in either direction, and limit switches may also be provided for terminating operation of the motor upon reaching either its operative or non-operative position.

Some of the objects and advantages of the invention having been stated, others will appear as the description proceeds when taken in connection with the accompanying drawings, in which FIG. 1 is a perspective environmental view illustrating an apparatus embodying the features of the present invention and the manner in which the apparatus may be mounted on a conventional fishing boat;

FIG. 3 is a view similar to FIG. 2, but illustrating the apparatus in its raised or retracted position;

FIG. 4 is a fragmentary sectional view taken substantially along the line 4—4 of FIG. 2;

FIG. 5 is a fragmentary plan view taken substantially along the line 5—5 of FIG. 3; and FIG. 6 is a schematic wiring diagram of the power control system for the apparatus of the present invention.

Referring more particularly to the drawings, an apparatus embodying the features of the present invention is indicated generally at 10, and is shown as being attached to the bow of a conventional fishing boat 12. The boat 12 also includes a conventional internal combustion outboard motor 14 mounted at the stern for powering the boat at relatively high speeds in the normal manner. Also, a battery 15, such as a 12 volt automotive battery, may be positioned in the boat for the purposes described below.

Figure 2:
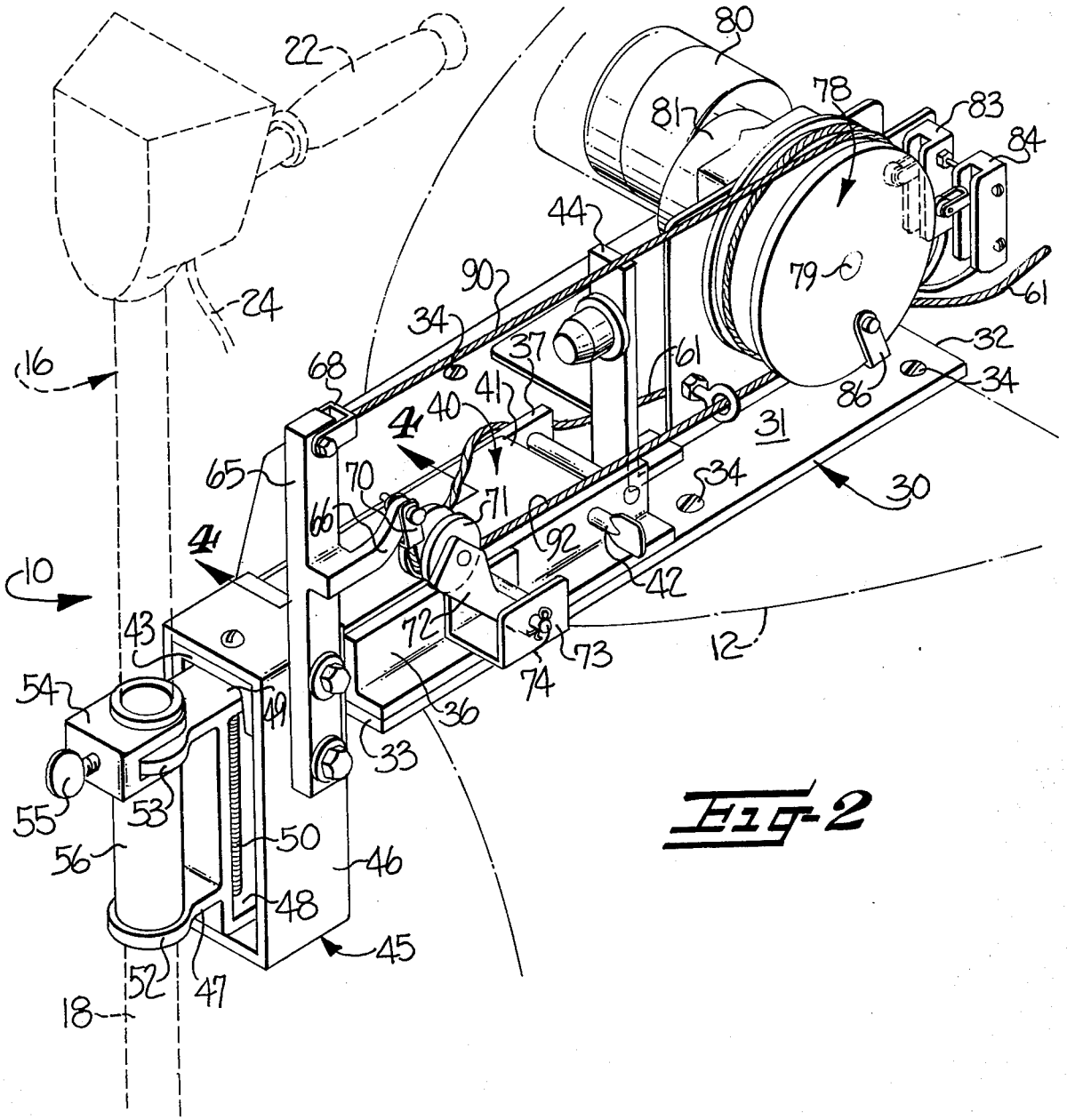
FIG. 2 is an enlarged perspective view of the apparatus shown in FIG. 1, and which illustrates the motor in its operative position.

In accordance with the present invention, the apparatus 10 is adapted to pivotally mount an auxiliary outboard motor 16 for movement between the operative position shown in FIG. 2, and the non-operative position shown in FIG. 3. The illustrated motor 16 is conventional, and comprises an elongated shaft 18 having a submersible electric motor 20 and propeller 21 carried at the lower end thereof, and a manually operable steering handle 22 carried at the upper end of the shaft. The shaft 18 comprises an inner tubular member and a coaxial outer sleeve (not shown) which are relatively rotatable about their common axis. The inner tubular member is directly connected to handle 22 and motor 20 to permit steering of the motor in the manner further described below. An electric cord 24 extends upwardly through the shaft 18, and is operatively connected to the battery 15 for powering the motor 20. Also, a suitable switch and rheostat (not shown) may be positioned adjacent the operator at the stern of the boat for selectively controlling the operation and speed of the motor 20.

The apparatus 10 comprises a mounting frame 30 which includes a generally flat plate 31 which defines an inner end 32 facing the interior of the boat and an outer end 33 which extends somewhat beyond the bow of the boat. The plate 31 is secured to the bow by any suitable arrangement, such as by screws 34, and it assumes a generally horizontal orientation.

A pair of spaced apart angle braces 36, 37 are fixedly mounted on the plate 31, as by welding, and overlie the outer end portion thereof. The braces 36, 37 define a channel therebetween which extends in a direction parallel to the longitudinal axis of the boat, the channel closely receiving a bracket 40 therewithin. The bracket 40 includes one end 41 which is mounted for pivotal movement about the pin 42, and a remote free end 43. The pin 42 extends transversely between the braces 36, 37 to define a first horizontal axis which is positioned at a medial point between the ends of the mounting plate 31.

The bracket 40 is accordingly pivotable between a forward position (FIG. 2) wherein the bracket horizontally overlies the outer end portion of the mounting plate 31, and a raised or retracted position (FIG. 3) wherein the bracket is disposed substantially vertically. In this regard, a vertically disposed abutment 44 is fixedly carried by the mounting plate and in alignment with the pivotal movement of the bracket 40 so as to be positioned to engage the bracket when the same is disposed in its retracted position, to thereby preclude further rearward pivotal movement. Also, it will be noted that the bracket 40 is of a length such that the remote free end 43 extends somewhat beyond the outer end 33 of the mounting plate when the bracket is positioned in its forward position.

The portion of the bracket 40 adjacent the free end 43 carries means generally indicated at 45 for releasably attaching the shaft 18 of the outboard motor 16 thereto, and such that the shaft of the motor extends substantially perpendicular to the bracket 40. More particularly, the means 45 includes a rigid box-like open frame 46 extending downwardly from the bracket, a shaft holder 47 having spaced inwardly directed legs 48, 49 received within the frame 46, and an elongated bolt 50 extending through the open frame and legs 48, 49 for releasably securing the holder 47 within the frame 46.

The holder 47 also includes outwardly directed spaced flanges 52, 53 having apertures therein for receiving the shaft 18, the upper flange 53 mounting a clamping member 54 and set screw 55 for securing the shaft at a desired vertical elevation. Also, a hard rubber split sleeve 56 is positioned to extend through the clamping member 54 and flanges 52, 53 for protecting the shaft 18 from damage. By this arrangement, the entire motor 16 may be easily removed from the apparatus 10 by removing the bolt 50 and withdrawing the holder 47 from the frame 46. Also, the depth to which the motor is disposed in the water may be controlled by adjusting the clamping member 54. The clamping member 54 fixedly retains the outer sleeve of the shaft 18, but steering is permitted in view of the relative rotation between the outer sleeve and inner tubular member of the shaft 18 as described above.

In order to positively lock the bracket 40 in its forward position, there is further provided a locking finger 58 which is pivotally carried by the bracket 40 as seen in FIG. 4. The inner end of the finger includes a notch 59 adapted to receive the tab 60, the tab in turn being fixedly carried by the plate 31. The outer end of the finger 58 has a cord 61 secured thereto, and a removable clamp 62 may be carried by the bracket 40 for engaging the cord and thereby locking the finger in the illustrated open or unlocked position.

The above described bracket 40, attaching means 45, locking finger 58, and cord 61 are similar to the presently known manually operable pivoting devices, and thus do not per se form a part of the present invention.

The bracket 40 includes a rigid arm 65 which is attached adjacent the free end 43 thereof, and which extends in a generally vertical direction when the bracket is positioned in its forward position as seen in FIG. 2. Also, the bracket further includes an inwardly directed rigid leg 66 extending from a medial portion of the arm 65, and in a direction generally perpendicular thereto. A U-shaped mounting element 68 is pivotally carried at the upper end of the arm 65 for the purposes described below, and a similar mounting element 70 is carried at the remote free end of the leg 66.

A pulley 71 is mounted generally below the free end of the leg 66 as seen in FIG. 2, and is rotatably carried by the U-shaped linkage 72, which in turn is mounted within a channel member 73. The channel member 73 is secured to the brace 36, as by welding, and the pulley 71 and linkage 72 are pivotally connected to the channel member for movement about the axis defined by the pin 74. A helical spring 75 surrounds the pin 74 (note FIG. 5) and acts to bias the linkage 72 and thus the pulley 71 downwardly.

A drive wheel 78 is carried by the mounting plate 31 for rotation about a second horizontal axis 79 which extends parallel to and spaced from the first horizontal axis defined by the pin 42. The drive wheel 78 is adapted to be selectively rotated in either direction by means of a reversible electric motor 80 of conventional construction and which acts through a gear reduction box 81 to rotate the drive wheel 78. The motor 80 is operatively connected to and powered by the battery 15, and as will be apparent from FIG. 2, the drive wheel 78, motor 80 and gear reduction box 81 are all mounted to overlie the inner end portion of the plate 31.

Figure 1:
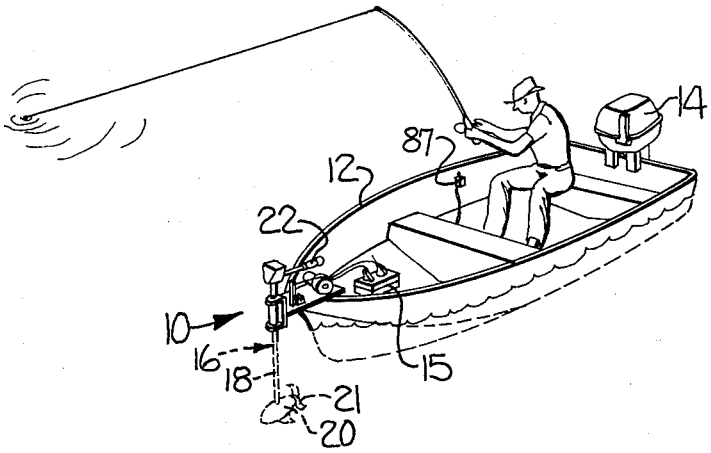

A pair of limit switches 83, 84 are carried by the plate 31 and positioned immediately adjacent the drive wheel 78, and the drive wheel carries a pair of cooperating actuating members 85, 86 for selectively opening the associated limit switch. Also, a manually operable control switch 87 is provided for selectively operating the motor 80 in either direction. Typically, the switch 87 is mounted toward the rear of the boat as seen in FIG. 1, and in a position to be conveniently controlled by the operator of the boat.

In accordance with the illustrated embodiment of the present invention, a pair of cable segments operatively interconnect the drive wheel 78 and bracket 40 whereby the bracket may be pivoted from its forward position to its retracted position upon rotation of the drive wheel in a first direction, and the bracket may be reversely pivoted upon rotation of the drive wheel in the opposite direction. More particularly, a first cable segment 90 has one end thereof attached to the mounting element 68 at the upper end of the arm 65, and an opposite end wound about the drive wheel in a clockwise direction (as seen in FIG. 2) and fixed thereto by any suitable securing device. The first cable segment 90 extends in a generally horizontal direction when the bracket is in its forward position, and it also may be said to extend from the arm 65 of the bracket in a first rotational direction with respect to the horizontal axis defined by the pin 42, such that rotation of the drive wheel in a clockwise direction acts to positively pivot the bracket 40 from its forward to its retracted position.

A second cable segment 92 has one end thereof attached to the mounting element 70 at the free end of the leg 66, and an opposite end wound about and fixed to the drive wheel in a counterclockwise direction. In addition, the second cable segment 92 is entrained about the pulley 71 so as to extend downwardly from the leg 66 and in the opposite rotational direction with respect to the horizontal axis of the pin 42. Thus rotation of the drive wheel in a counterclockwise direction acts to positively pivot the bracket from its retracted position to its forward position.

As will be apparent, the downwardly directed biasing force resulting from the spring 75 acts through the pulley 71 and to tension the second cable segment 92 and thereby resiliently maintain the bracket 40 in its forward position. This resilient tensioning force serves to resist inadvertent upward movement of the bracket, and effectively precludes the motor 16 from lifting from the water during operation. The spring biasing force from the spring 75 is normally adequate for this purpose, but where unusual forces are encountered, the operator may release the finger 58 to positively lock the bracket in its forward position. In this regard, it will be understood that the reduction gear box 81 serves to resist inadvertent rotation of the drive wheel caused by tension in either of the cable segments, and thus it resists inadvertent movement of the bracket. Also, while the cable segments 90, 92 have been described as separate elements herein, it will be understood that the two segments could comprise a unitary cable which is wound completely about the drive wheel at least once. This latter arrangement has the advantage of serving as a slip-clutch between the drive wheel and cable in the event an obstruction is encountered in the pivotal movement of the bracket 40 and motor 16.

In use, the operator initially mounts the motor 16 at the free end of the bracket 40 by inserting and locking the holder 47 within the frame 46 in the manner described above. Assuming the bracket is in its raised or retracted position as seen in FIG. 3, the motor 16 may be brought into its operative position by the boat operator closing the switch into its "down" position. The motor 80 is thereby energized to rotate the drive wheel 78 counterclockwise as seen in FIG. 3 and such that the second cable segment 92 pulls forwardly and downwardly upon the leg 66 to thereby pivot the bracket 40 in a counterclockwise direction about the axis defined by the pin 42. As will be understood, the counterclockwise rotation of the drive wheel 78 also unwinds a sufficient length of the first cable segment 91 to permit the described pivotal movement of the bracket and motor 16 to proceed under controlled movement. In other words, the first cable segment 90 serves to prevent the sudden dropping of the bracket and motor after the center of gravity passes over the axis of the pin 42.

Upon the bracket 40 reaching its fully lowered or forward position as seen in FIGS. 2 and 6, the actuating member 85 engages and opens the limit switch 83 to automatically terminate operation of the motor 80. As will be understood, the actuating member 85 is positioned at a predetermined location on the periphery of the drive wheel 78 to effect termination of operation concurrently with the bracket reaching its forward position.

When it is desired to retract the motor 16, the operator closes the switch into its "up" position, thereby causing the motor 80 and drive wheel 78 to rotate clockwise as seen in FIG. 2. The first cable segment 90 thus pulls inwardly on the arm 65, causing the bracket to pivot rearwardly about the axis of the pin 42. Such rotation continues until the actuating member 86 carried by the drive wheel opens the limit switch 84, which is predetermined to occur when the bracket reaches its raised position.

In the drawings and specification, there has been set forth a preferred embodiment of the invention, and although specific terms are employed, they are used in a generic and descriptive sense only and not for purposes of limitation.

What is claimed is:

1. An apparatus for pivotally mounting an outboard motor on a fishing boat or the like and such that the motor may be selectively and remotely pivoted between a vertically disposed lowered position wherein the motor is operatively held in the water and a horizontally disposed raised position wherein the motor is removed from the water, said apparatus comprising a mounting frame adapted to be fixedly attached to a boat, a drive wheel rotatably carried by said mounting frame, means for selectively rotating said drive wheel in either direction, and including a reversible electric motor carried by said frame and a manually operable switch for operating said electric motor in either direction, a bracket pivotally carried by said mounting frame for pivotal movement in a vertical plane about a fixed horizontal axis and between a forward position and a retracted position, means carried by said bracket for supportingly attaching the shaft of an outboard motor thereto and such that the outboard motor is disposed in its lowered position when said bracket is in its forward position and the outboard motor is disposed in its raised position when said bracket is in its retracted position, cable means operatively interconnecting said drive wheel and bracket and including a first cable segment extending from said bracket in a first rotational direction with respect to said horizontal axis, and a second cable segment extending from said bracket in the opposite rotational direction with respect to said horizontal axis, whereby said bracket may be pivoted from said forward position to said retracted position upon rotation of said drive wheel in a first direction and the bracket may be reversely pivoted upon rotation of said drive wheel in the opposite direction.

2. The apparatus as defined in claim 1 wherein said means for selectively rotating said drive wheel comprises a reduction gear interposed between said electric motor and drive wheel, said reduction gear serving to resist inadvertent rotation of the drive wheel and thus movement of said bracket.

3. The apparatus as defined in claim 2 wherein said means for selectively rotating said drive wheel further comprises first and second limit switches carried by said mounting frame, with said first limit switch adapted to automatically terminate operation of said motor upon said bracket reaching said forward position and said second limit switch adapted to automatically terminate operation of said motor upon said bracket reaching said retracted position.

4. The apparatus as defined in claim 3 wherein said forward position of said bracket is substantially horizontal and said retracted position of said bracket is substantially vertical, and wherein said attaching means is adapted to attach the shaft of an outboard motor with the shaft extending substantially perpendicular to the direction of said bracket.

5. The apparatus as defined in claim 4 further comprising means for tensioning said second cable segment to resist inadvertent upwardly directed movement of said bracket.

6. The apparatus as defined in claim 2 further comprising releasable means for positively locking said bracket in said forward position to preclude upward movement of said bracket.

7. An apparatus for pivotally mounting an outboard motor, such as a shaft-mounted submersible electric motor, on a fishing boat or the like and such that the motor may be selectively and remotely pivoted between a vertically disposed operative position in the water and a horizontally disposed raised position removed from the water, said apparatus comprising, a mounting frame adapted to be fixedly attached to a boat so as to extend in a generally horizontal direction and define an inner end positioned within the boat and an outer end positioned somewhat beyond the bow of the boat, a bracket having one end thereof pivotally connected to said frame for rotation about a first horizontal axis positioned at a point intermediate the ends of said frame, and a remote free end, said bracket being pivotable between a forward position wherein said bracket horizontally overlies said outer end of said frame and a retracted position wherein said bracket is disposed substantially vertically, and said bracket being of a length such that said remote free end extends beyond said outer end of said frame when said bracket is positioned in said forward position, means carried at said remote free end of said bracket for releasably attaching the shaft of an outboard motor thereto and with the shaft of the motor extending substantially perpendicular to said bracket, a drive wheel carried by said frame and being rotatable about a fixed axis, means for selectively rotating said drive wheel in either direction about said fixed axis, and including a reversible electric motor carried by said frame adjacent said inner end thereof, and a manually operable switch for selectively operating said motor in either direction, a pulley rotatably carried by said frame adjacent said outer end thereof, a first cable segment having one end attached to said bracket and an opposite end wound about said drive wheel, said first cable segment extending from said bracket in a first rotational direction with respect to said first horizontal axis such that rotation of said drive wheel in a first direction acts to pivot said bracket from said forward to said retracted position, and a second cable segment having one end attached to said bracket and an opposite end wound about said drive wheel in a direction opposite that of said first cable segment, said second cable segment being entrained about said pulley so as to extend from said bracket in the opposite rotational direction with respect to said first horizontal axis such that rotation of said drive wheel in a direction opposite said first direction acts to pivot said bracket from said retracted position to said forward position.

8. The apparatus as defined in claim 7 wherein said pulley is disposed immediately below the point at which said second cable segment is attached to said bracket when said bracket is disposed in said forward position, and wherein said pulley includes spring biasing means for urging the pulley downwardly under a resilient force, whereby said spring biasing means acts to tension said second cable segment and thereby resiliently maintain said bracket in its forward position and the outboard motor in its operative position.

9. The apparatus as defined in claim 8 wherein said first horizontal axis is located at a medial position along the length of said frame, and said drive wheel is located adjacent said inner end and is rotatable about a second horizontal axis which is parallel to said first horizontal axis.

10. The apparatus as defined in claim 9 further comprising vertically disposed abutment means fixedly carried by said frame and positioned to engage said bracket when said bracket is disposed in said retracted position for precluding pivotal movement of said bracket beyond said retracted position.

11. The apparatus as defined in claim 10 wherein said bracket includes a rigid arm extending in a generally vertical direction from said remote free end when said bracket is disposed in said forward position, and an inwardly directed rigid leg extending from a medial portion of said arm in a direction generally perpendicular thereto, said leg defining a free end which is positioned immediately above said pulley when said bracket is disposed in said forward position, and wherein said first cable segment is attached to said bracket at the upper end of said arm and said second cable segment is attached to said bracket at said free end of said leg.

12. The apparatus as defined in claim 11 wherein said means for selectively rotating said drive wheel in either direction comprises first and second limit switches mounted immediately adjacent said drive wheel, and means carried by said drive wheel for selectively actuating said first and second limit switches such that said first limit switch automatically terminates operation of said motor upon said bracket reaching said forward position and said second limit switch automatically terminates operation of said motor upon said bracket reaching said retracted position.

* * * * *